US008391532B2

(12) United States Patent
Chiu et al.

(10) Patent No.: US 8,391,532 B2
(45) Date of Patent: Mar. 5, 2013

(54) IN-EAR EARPHONE

(75) Inventors: Chun-Ching Chiu, Taipei (TW); Mu-Tsun Tseng, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 309 days.

(21) Appl. No.: 12/986,695

(22) Filed: Jan. 7, 2011

(65) Prior Publication Data

US 2012/0177241 A1 Jul. 12, 2012

(51) Int. Cl.
*H04R 25/00* (2006.01)

(52) U.S. Cl. ..... 381/370; 381/371; 381/380

(58) Field of Classification Search ..... 381/370, 381/371, 372, 374, 380; 128/864, 867; 455/575.1; 379/430; 181/129, 130, 136, 153, 199
See application file for complete search history.

(56) References Cited

U.S. PATENT DOCUMENTS 8,032,191 B2 * 10/2011 Yang ..... 381/380
8,265,322 B2 * 9/2012 Uchida et al. ..... 381/370
8,265,323 B2 * 9/2012 Stiehl et al. ..... 381/371

* cited by examiner

*Primary Examiner* — Brian Ensey
(74) *Attorney, Agent, or Firm* — WPAT, P.C.; Anthony King

(57) ABSTRACT

An in-ear earphone has a shell including an upper shell and a lower shell cooperating with the upper shell to define a resonance space for receiving a loudspeaker. A plurality of damping objects are made of different elastic and compressible materials. A group of first adjusting elements are capable of being replaceablely assembled to the lower shell for receiving external sound signals. Each first adjusting element defines a receiving fillister and a sound hole connected with the receiving fillister. Each first adjusting element has one damping object disposed in the receiving fillister and further disposed between the sound hole and the resonance space. A group of second adjusting elements are capable of being replaceablely assembled to the upper shell for transmitting the sound signals out. Each second adjusting element defines a receiving cavity for receiving one of the damping objects therein and makes it face to the resonance space.

8 Claims, 4 Drawing Sheets

IN-EAR EARPHONE

BACKGROUND OF THE INVENTION

1. Field of the Invention

The present invention relates to an earphone, and particularly to an in-ear earphone capable of adjusting the sound effect.

2. The Related Art

With the development of science and technology, electronic products are continuously upgraded. In order to assure that users can listen to the sound generated by the electronic product avoid being not interfered by ambient noises, an in-ear earphone served as a necessary accessory of the electronic product is needed.

A conventional in-ear earphone connected with a music player includes a shell defining a resonance space therein, and a loudspeaker received in the resonance space of the shell. The shell has a through hole interconnecting the resonance space with the outside region. A damping object is fixed inside the shell and blocks the through hole in order to smoothen the frequency response of the sound pressure level in the resonance space while the loudspeaker makes sound. So, the in-ear earphone can achieve a perfect sound effect. However, as the damping object is fixed in the shell, it is impossible to change the sound effect by means of replacing the damping object.

SUMMARY OF THE INVENTION

Accordingly, an object of the present invention is to provide an in-ear earphone. The in-ear earphone comprises a shell including an upper shell and a lower shell cooperating with the upper shell to define a resonance space therebetween. A loudspeaker is assembled in the resonance space of the shell. A plurality of damping objects are made of different elastic and compressible materials for achieving different sound effects. A group of first adjusting elements are capable of being replaceablely assembled to a bottom of the lower shell for receiving external sound signals for the loudspeaker. Each of the first adjusting elements defines a receiving fillister penetrating through a top thereof. A sound hole is opened in a substantial middle of a bottom of the first adjusting element and connects with the receiving fillister. Each of the first adjusting elements has one damping object disposed in the receiving fillister and further disposed between the sound hole and the resonance space. A group of second adjusting elements are capable of being replaceablely assembled to a top of the upper shell for transmitting the sound signals out. Each of the second adjusting elements defines a receiving cavity at a top end thereof for receiving one of the damping objects therein. The damping object further faces to the resonance space.

As described above, the first and the second adjusting elements are respectively provided with different damping objects therein, and then the in-ear earphone utilizes the group of first adjusting elements to be replaceablely assembled to the lower shell to achieve the different low-frequency sound effects, and the group of second adjusting elements to be replaceablely assembled to the upper shell to achieve the different high-frequency sound effects. So, users can conveniently adjust the sound effects and enjoy themselves by replacing the first adjusting elements and the second adjusting elements, which have the different damping objects therein, in the process of using the in-ear earphone.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
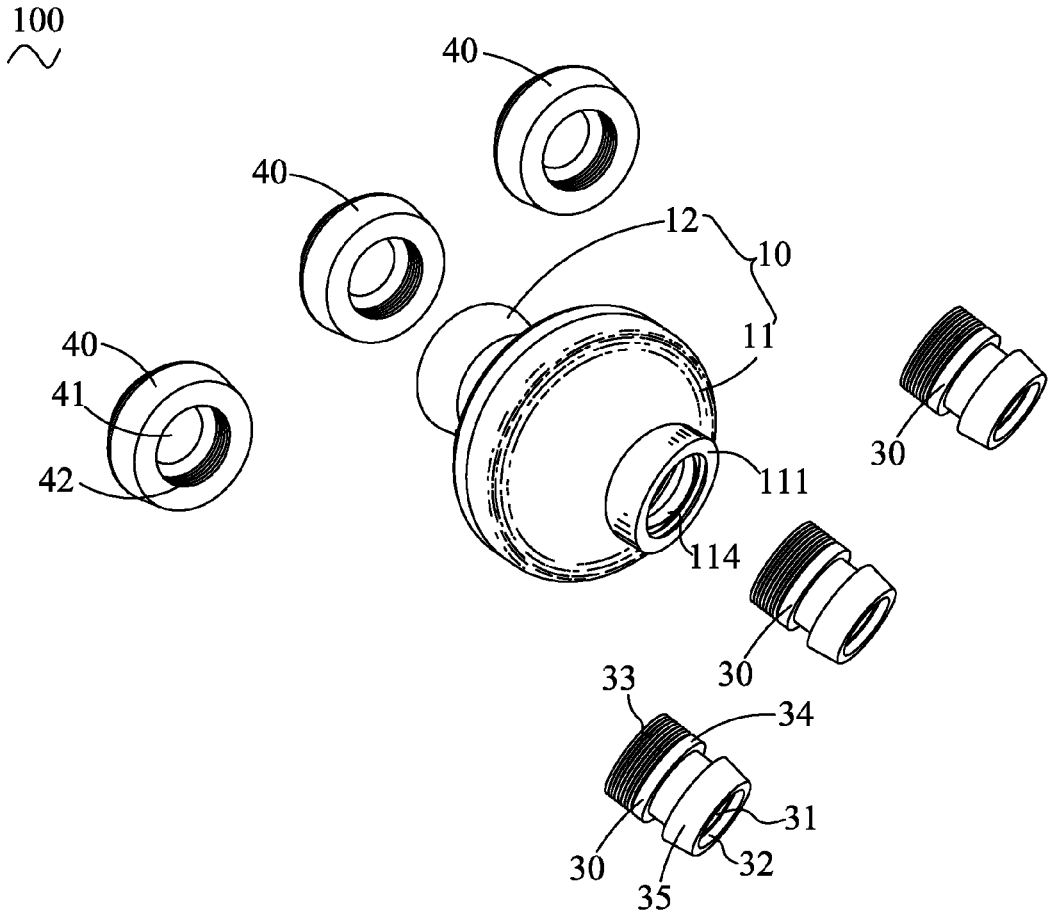
FIG. 1 is a partially exploded, perspective view of an in-ear earphone in accordance with the present invention.
Figure 2:
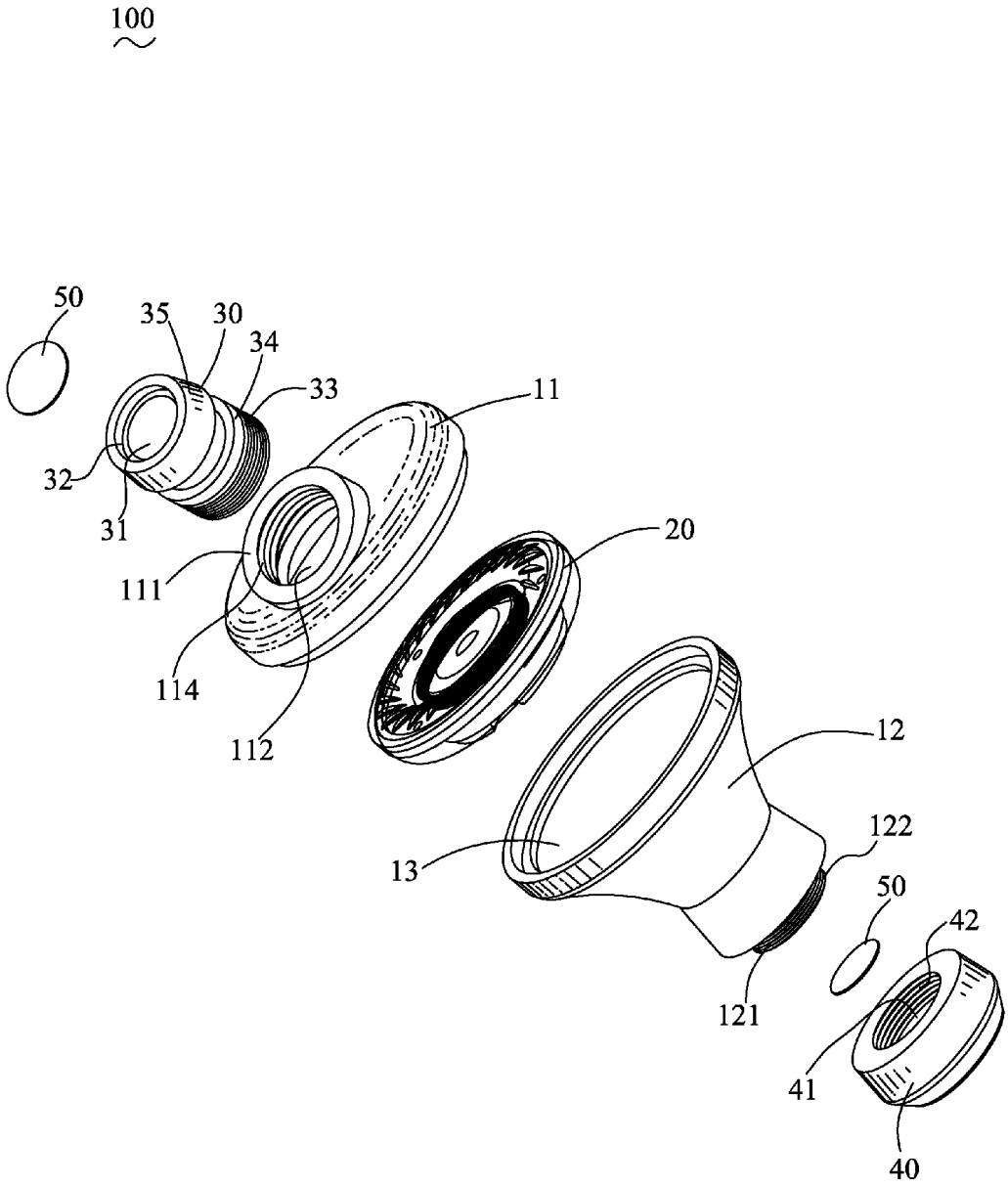
FIG. 2 is an exploded, perspective view of the in-ear earphone of FIG. 1.

Referring to the drawings in greater detail, and first to FIGS. 1-2, the embodiment of the invention is embodied in an in-ear earphone 100. The in-ear earphone 100 comprises a shell 10, a loudspeaker 20, a group of first adjusting elements 40, a group of second adjusting elements 30 and a plurality of damping objects 50.

Figure 3:
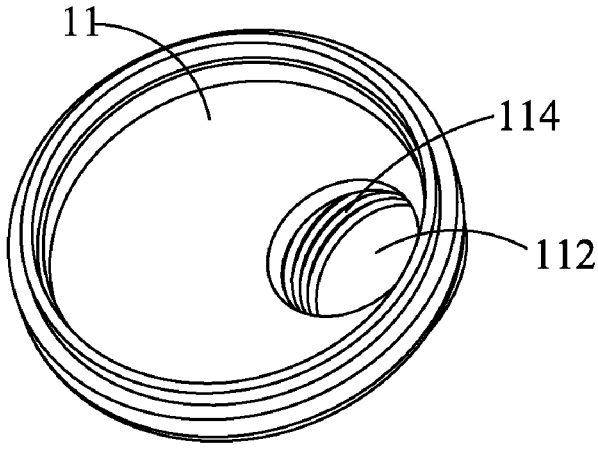
FIG. 3 is a perspective view of an upper shell of the in-ear earphone of FIG. 2.

Referring to FIGS. 2-3, the shell 10 includes an upper shell 11 and a lower shell 12 cooperating with the upper shell 11 to define a resonance space 13 therebetween for receiving the loudspeaker 20 therein. A top of the upper shell 11 slantwise protrudes upward to form a cylindrical supporting portion 111. The supporting portion 111 defines a through hole 112 penetrating therethrough along the extension direction thereof and communicating with the resonance space 13. A bottom of the lower shell 12 protrudes downward to form a connecting portion 121 with a through channel (not shown) penetrating therethrough along the extension direction thereof to communicate with the resonance space 13. An outer periphery side of the connecting portion 121 defines a first male screw thread 122.

Figure 4:
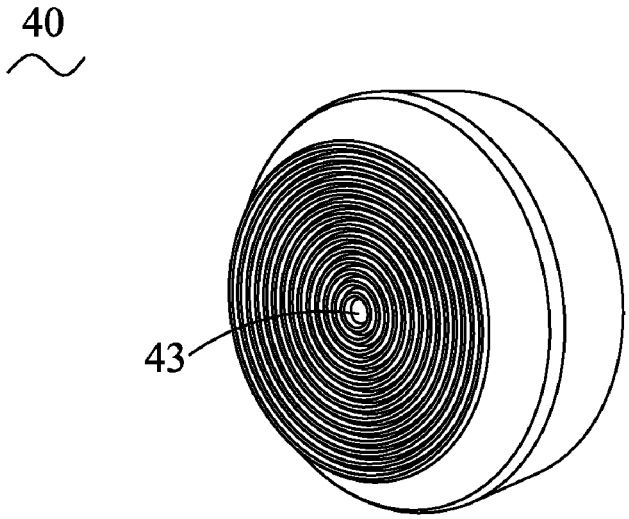
FIG. 4 is a perspective view of a first adjusting element of the in-ear earphone of FIG. 2.

Referring to FIGS. 1-2 and FIG. 4, each of the first adjusting elements 40 is substantially column-shaped and defines a receiving fillister 41 penetrating through a top thereof. A sound hole 43 is opened in a substantial middle of a bottom of the first adjusting element 40 and connected with a bottom of the receiving fillister 41. A first female screw thread 42 is provided on an inner periphery side of the receiving fillister 41.

Figure 5:
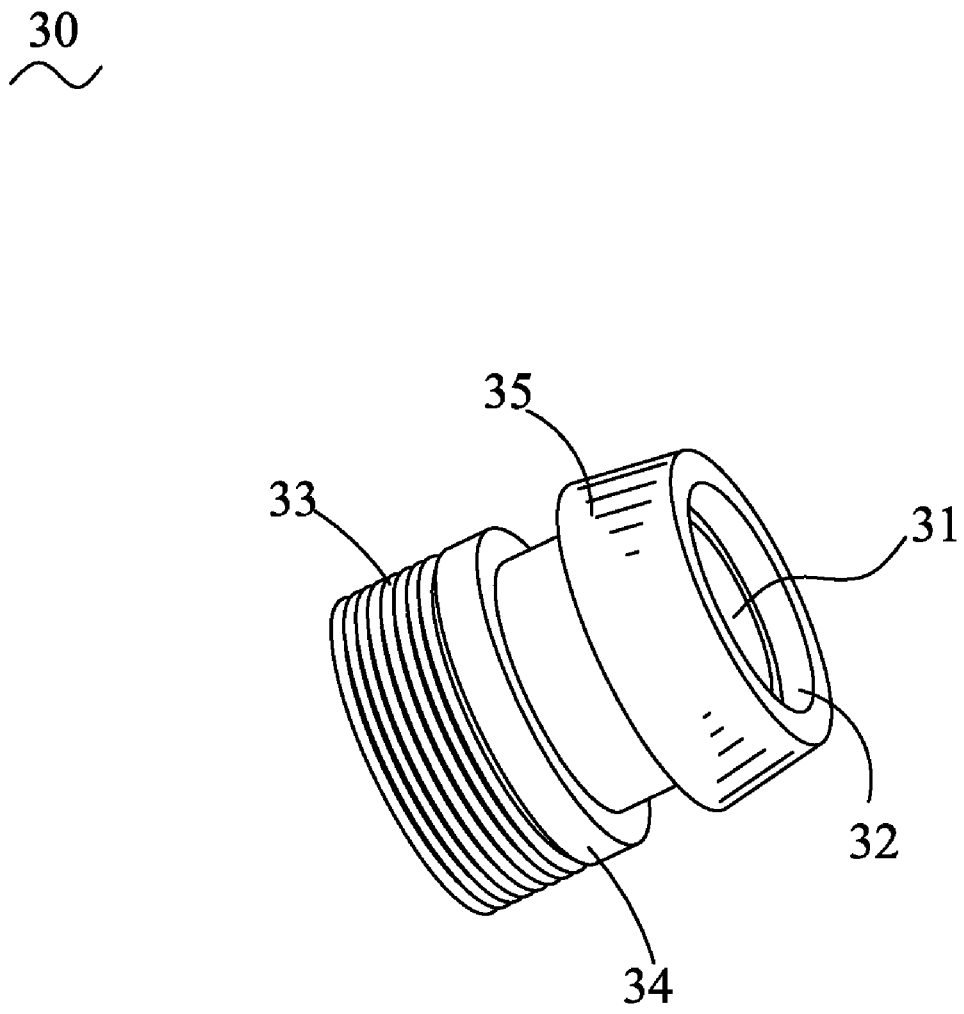
FIG. 5 is a perspective view of a second adjusting element of the in-ear earphone of FIG. 2.

Referring to FIGS. 1-2 and FIG. 5, each of the second adjusting elements 30 has a cylindrical connecting body 34 and an in-ear portion 35 of cone frustum shape protruding upwards from a top end of the connecting body 34. The in-ear portion 35 defines a receiving cavity 32 at a top end thereof for receiving one of the damping objects 50 therein. The connecting body 34 defines a sound-guiding hole 31 penetrating therethrough to communicate with the receiving cavity 32. The sound-guiding hole 31 has a smaller diameter than the one of the receiving cavity 32. An outer periphery side of the connecting body 34 defines a second male screw thread 33. A second female screw thread 114 is provided at an inner periphery side of the through hole 112 of the supporting portion 111 of the upper shell 11.

Referring to FIG. 1 and FIG. 2, the damping objects 50 are made of different elastic and compressible materials such as sponge, elastic plastic, textile and so on. In this embodiment, the plurality of damping objects 50 are divided into two groups, wherein one group of damping objects 50 are used to achieve different low-frequency sound effects and have equal numbers to that of the group of first adjusting elements 40 to be respectively disposed in the receiving fillisters 41 of the first adjusting elements 40, another group of damping objects 50 are used to achieve different high-frequency sound effects and have equal numbers to that of the group of second adjusting elements 30 to be respectively disposed in the receiving cavities 32 of the second adjusting elements 30. The first adjusting elements 40 are identified by different colors (not shown in FIG. 1) respectively to make a distinction among the different low-frequency sound effects, and the second adjusting elements 30 are also identified by different colors (not shown in FIG. 1) respectively to make a distinction among the different high-frequency sound effects. Furthermore, in this embodiment, the in-ear earphone 100 has three replaceable first adjusting elements 40 and three replaceable second adjusting elements 30.

Referring to FIGS. 1-5, in assembly, the upper shell 11 cooperates with the lower shell 12 and the loudspeaker 20 is received in the resonance space 13 of the shell 10. The group of first adjusting elements 40 each is capable of being demountably assembled to the connecting portion 121 of the lower shell 12 for receiving external sound signals for the loudspeaker 20. The damping object 50 disposed in the receiving fillister 41 of the first adjusting element 40 is further clipped between the connecting portion 121 and a bottom side of the receiving fillister 41 and faces to the resonance space 13 through the through channel of the connecting portion 121. In this embodiment, the first adjust element 40 is screwed to the connecting portion 121 of the lower shell 12 by means of the first male screw thread 122 engaging with the first female screw thread 42. The group of second adjusting elements 30 each is capable of being demountably assembled to the supporting portion 111 of the upper shell 11 for transmitting the sound signals out. The damping object 50 disposed in the receiving cavity 32 of the second adjusting element 30 further faces to the resonance space 13 through the sound-guiding hole 31. In this embodiment, the second adjusting element 30 is screwed to the supporting portion 111 by means of the connecting body 34 being inserted in the through hole 112 and the second male screw thread 33 engaging with the second female screw thread 114.

As described above, the first and the second adjusting elements 40, 30 are respectively provided with different damping objects 50 therein, and then the in-ear earphone 100 utilizes the group of first adjusting elements 40 to be replaceablely assembled to the lower shell 12 to achieve the different low-frequency sound effects, and the group of second adjusting elements 30 to be replaceablely assembled to the upper shell 11 to achieve the different high-frequency sound effects. So, users can conveniently adjust the sound effects and enjoy themselves by replacing the first adjusting elements 40 and the second adjusting elements 30, which have the different damping objects 50 therein, in the process of using the in-ear earphone 100.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An in-ear earphone, comprising:

a shell including an upper shell and a lower shell cooperating with the upper shell to define a resonance space therebetween;

a loudspeaker assembled in the resonance space of the shell;

a plurality of damping objects made of different elastic and compressible materials for achieving different sound effects;

a group of first adjusting elements capable of being replaceablely assembled to a bottom of the lower shell for receiving external sound signals for the loudspeaker, each of the first adjusting elements defining a receiving fillister penetrating through a top thereof, a sound hole being opened in a substantial middle of a bottom of the first adjusting element and connected with the receiving fillister, each of the first adjusting elements having one damping object disposed in the receiving fillister and further disposed between the sound hole and the resonance space; and a group of second adjusting elements capable of being replaceablely assembled to a top of the upper shell for transmitting the sound signals out, each of the second adjusting elements defining a receiving cavity at a top end thereof for receiving one of the damping objects therein, the damping object further facing to the resonance space.

2. The in-ear earphone as claimed in claim 1, wherein the damping objects disposed in the first adjusting elements achieve different low-frequency sound effects respectively, and the first adjusting elements are identified by different colors respectively to make a distinction among the different low-frequency sound effects.

3. The in-ear earphone as claimed in claim 1, wherein the damping objects disposed in the second adjusting elements achieve different high-frequency sound effects respectively, and the second adjusting elements are identified by different colors respectively to make a distinction among the different high-frequency sound effects.

4. The in-ear earphone as claimed in claim 1, wherein the bottom of the lower shell protrudes downward to form a connecting portion with a through channel penetrating therethrough along the extension direction thereof to communicate with the resonance space, the connecting portion is inserted in the receiving fillister of the first adjusting element, the damping object is further clipped between the connecting portion and a bottom side of the receiving fillister and faces to the resonance space through the through channel.

5. The in-ear earphone as claimed in claim 4, wherein a female screw thread is provided on an inner periphery side of the receiving fillister and an outer periphery side of the connecting portion defines a male screw thread, the first adjusting element is screwed to the connecting portion by means of the male screw thread engaging with the female screw thread.

6. The in-ear earphone as claimed in claim 1, wherein the top of the upper shell slantwise protrudes upward to form a supporting portion defining a through hole which penetrates through the supporting portion along the extension direction of the supporting portion and is connected with the resonance space, each of the second adjusting elements has a connecting body and an in-ear portion protruding upward from a top end of the connecting body, the receiving cavity is opened in the in-ear portion, the connecting body defines a sound-guiding hole penetrating therethrough to communicate with the receiving cavity, the second adjusting element is demountably assembled to the supporting portion by means of the connecting body inserted in the through hole, the damping object faces to the resonance space through the sound-guiding hole.

7. The in-ear earphone as claimed in claim 6, wherein a female screw thread is provided on an inner periphery side of the through hole and an outer periphery side of the connecting body defines a male screw thread, the second adjusting element is screwed to the supporting portion by means of the male screw thread engaging with the female screw thread.

8. The in-ear earphone as claimed in claim 6, wherein the sound-guiding hole has a smaller diameter than the one of the receiving cavity.

* * * * *